US008265536B2

(12) United States Patent
Condello et al.

(10) Patent No.: US 8,265,536 B2
(45) Date of Patent: Sep. 11, 2012

(54) FIXING SYSTEMS INCLUDING CONTACT PRE-HEATER AND METHODS FOR FIXING MARKING MATERIAL TO SUBSTRATES

(75) Inventors: Anthony S. Condello, Webster, NY (US); Dale R. Mashtare, Bloomfield, NY (US); Grace T. Brewington, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 12/855,066

(22) Filed: Aug. 12, 2010

(65) Prior Publication Data

US 2012/0040286 A1 Feb. 16, 2012

(51) Int. Cl.
*G03G 15/20* (2006.01)

(52) U.S. Cl. ..... 399/328

(58) Field of Classification Search ..... 399/328
See application file for complete search history.

(56) References Cited

U.S. PATENT DOCUMENTS

| | | | | |
|---|---|---|---|---|
| 4,563,075 | A * | 1/1986 | Mosholder | 399/339 |
| 6,996,362 | B2 * | 2/2006 | Kellie et al. | 399/328 |
| 7,322,689 | B2 | 1/2008 | Kohne et al. | |
| 7,402,371 | B2 | 7/2008 | Sacripante et al. | |
| 7,407,278 | B2 | 8/2008 | Kohne et al. | |
| 7,494,757 | B2 * | 2/2009 | Sacripante et al. | 430/137.1 |
| 7,547,499 | B2 | 6/2009 | Veregin et al. | |
| 7,682,014 | B2 | 3/2010 | Snyder et al. | |
| 2003/0223792 | A1 * | 12/2003 | Chen et al. | 399/341 |
| 2004/0057741 | A1 * | 3/2004 | Uehara et al. | 399/69 |
| 2009/0009573 | A1 | 1/2009 | Larson et al. | |
| 2009/0021550 | A1 | 1/2009 | Leighton et al. | |
| 2009/0102906 | A1 | 4/2009 | Phillips et al. | |
| 2010/0045720 | A1 | 2/2010 | Williams et al. | |

OTHER PUBLICATIONS

James Williams et al.; Temperature Leveling Roller and Pressure Nip Assembly; U.S. Appl. No. 12/617,255, filed Nov. 12, 2009.

* cited by examiner

*Primary Examiner* — Walter L Lindsay, Jr.
*Assistant Examiner* — Frederick Wenderoth
(74) *Attorney, Agent, or Firm* — Ronald E. Prass, Jr.; Prass LLP

(57) ABSTRACT

Fixing systems and methods for fixing marking material to a substrate are provided. An exemplary embodiment of the fixing systems includes a pre-heating device including: a first fixing member including a first surface; a second fixing member including a second surface forming a first nip with the first surface; and a first thermal energy source for heating at least one of the first surface and the second surface; wherein the first surface and the second surface contact and pre-heat a substrate and marking material comprising toner disposed on a surface of the substrate when the substrate is received at the first nip to produce the temperature condition: $T_{amb}<T_{int}<T_m$, where $T_{amb}$ is the ambient temperature, $T_{int}$ is the temperature at an interface between the marking material and the surface of the substrate, and $T_m$ is the melting temperature of the toner, the pre-heated toner adheres to the substrate substantially without adhering to the first surface or the second surface; and a fixing device disposed downstream from the pre-heating device including: a third fixing member including a third surface; and a fourth fixing member including a fourth surface forming a second nip with the third surface at which the pre-heated substrate is received. The third fixing member and fourth fixing member apply pressure to the pre-heated substrate and marking material at the second nip to fix the toner to the substrate.

21 Claims, 7 Drawing Sheets

FIXING SYSTEMS INCLUDING CONTACT PRE-HEATER AND METHODS FOR FIXING MARKING MATERIAL TO SUBSTRATES

RELATED APPLICATIONS

This application is related to the applications entitled "MULTI-STAGE FIXING SYSTEMS, PRINTING APPARATUSES AND METHODS OF FIXING MARKING MATERIAL TO SUBSTRATES" Ser. No. 12/855,011; "FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB" Ser. No. 12/855,036; "FIXING DEVICES INCLUDING LOW-VISCOSITY RELEASE AGENT APPLICATOR SYSTEM AND METHODS OF FIXING MARKING MATERIAL TO SUBSTRATES" Ser. No. 12/855,054; "FIXING SYSTEMS INCLUDING IMAGE CONDITIONER AND IMAGE PRE-HEATER AND METHODS OF FIXING MARKING MATERIAL TO SUBSTRATES" Ser. No. 12/855,078; "FIXING DEVICES INCLUDING EXTENDED-LIFE COMPONENTS AND METHODS OF FIXING MARKING MATERIAL TO SUBSTRATES" Ser. No. 12/855,106; and "LOW ADHESION COATINGS FOR IMAGE FIXING" Ser. No. 12/855,140, each of which is filed on the same date as the present application, commonly assigned to the assignee of the present application, and incorporated herein by reference in its entirety.

BACKGROUND

In some printing apparatuses, toner is applied to a substrate to form an image. The image can be heated while being subjected to pressure by a fixing device to fix the toner to the substrates. In these apparatuses, the fixing device can be subjected to temperature conditions that shorten the lifetime of components of the fixing device.

It would be desirable to provide fixing systems and methods for fixing marking material to a substrate that can utilize temperature conditions that allow lower run costs and desirable image quality.

SUMMARY

Fixing systems and methods of fixing marking material to a substrate are provided. An exemplary embodiment of the fixing systems comprises a pre-heating device comprising: a first fixing member including a first surface; a second fixing member including a second surface forming a first nip with the first surface; and a first thermal energy source for heating at least one of the first surface and the second surface; wherein the first surface and the second surface contact and pre-heat a substrate and marking material comprising toner disposed on a surface of the substrate when the substrate is received at the first nip to produce the temperature condition: $T_{amb}<T_{int}<T_m$, where $T_{amb}$ is the ambient temperature, $T_{int}$ is the temperature at an interface between the marking material and the surface of the substrate, and $T_m$ is the melting temperature of the toner, the pre-heated toner adheres to the substrate substantially without adhering to the first surface or the second surface; and a fixing device disposed downstream from the pre-heating device comprising: a third fixing member including a third surface; and a fourth fixing member including a fourth surface forming a second nip with the third surface at which the pre-heated substrate is received. The third fixing member and fourth fixing member apply pressure to the pre-heated substrate and marking material at the second nip to fix the toner to the substrate.

DRAWINGS

DETAILED DESCRIPTION

Figure 1:
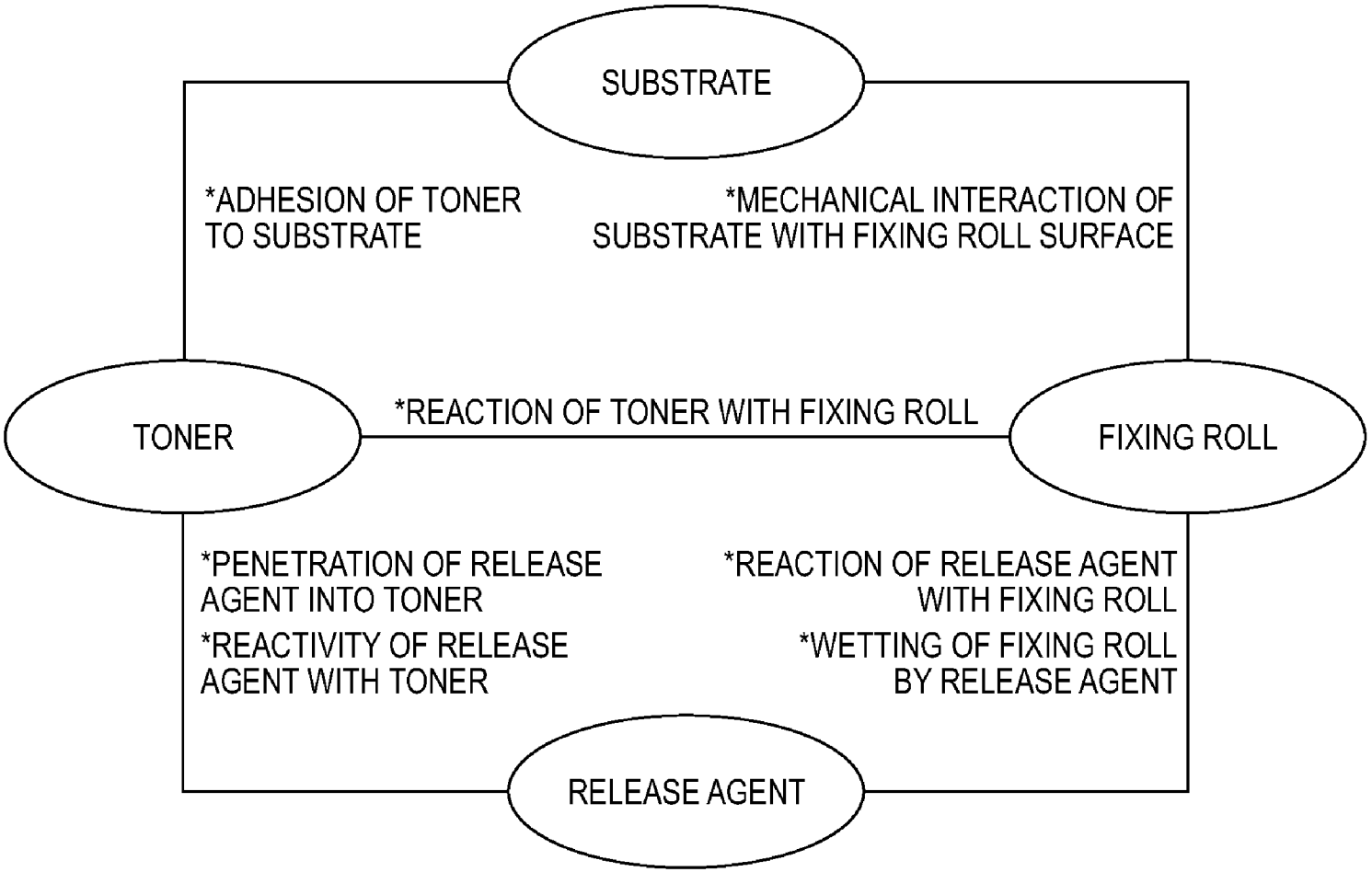
FIG. 1 illustrates mechanical and chemical interactions that may occur between components of a fixing device, toner and a release agent at a fixing nip.

The disclosed embodiments include fixing systems for fixing marking material to substrates. An exemplary embodiment of the fixing systems comprises a pre-heating device comprising: a first fixing member including a first surface; a second fixing member including a second surface forming a first nip with the first surface; and a first thermal energy source for heating at least one of the first surface and the second surface; wherein the first surface and the second surface contact and pre-heat a substrate and marking material comprising toner disposed on a surface of the substrate when the substrate is received at the first nip to produce the temperature condition: $T_{amb}<T_{int}<T_m$, where $T_{amb}$ is the ambient temperature, $T_{int}$ is the temperature at an interface between the marking material and the surface of the substrate, and $T_m$ is the melting temperature of the toner, the pre-heated toner adheres to the substrate substantially without adhering to the first surface or the second surface; and a fixing device disposed downstream from the pre-heating device comprising: a third fixing member including a third surface; and a fourth fixing member including a fourth surface forming a second nip with the third surface at which the pre-heated substrate is received. The third fixing member and fourth fixing member apply pressure to the pre-heated substrate and marking material at the second nip to fix the toner to the substrate.

Another exemplary embodiment of the fixing systems comprises a pre-heating device comprising: a first fixing member including a first surface; a second fixing member including a second surface forming a first nip with the first surface; and a first thermal energy source for heating at least one of the first surface and the second surface; wherein the first surface and the second surface contact and pre-heat a substrate and marking material comprising toner disposed on the substrate when the substrate is received at the first nip; and a fixing device disposed downstream from the pre-heating device comprising: a third fixing member including a third surface; a fourth fixing member including a fourth surface forming a second nip with the third surface at which the pre-heated substrate is received; and a second thermal energy source for heating at least one of the third surface and fourth surface, wherein the at least one of the third surface and fourth surface that is heated is heated to a temperature of less than about 120° C. The third fixing member and fourth fixing member apply heat and pressure to the pre-heated substrate and marking material at the second fixing nip to fix the toner to the substrate.

The disclosed embodiments further include methods of fixing toner to a substrate. An exemplary embodiment of the methods comprises applying marking material comprising toner to a substrate with a marking device; feeding the substrate to a first nip of a pre-heating device, the first nip being formed by a first surface of a first fixing member and a second surface of a second fixing member; heating at least one of the first surface and the second surface; contacting and pre-heating the substrate and marking material at the first nip to produce the temperature condition: $T_{amb}<T_{int}<T_m$, where $T_{amb}$ is the ambient temperature, $T_{int}$ is the temperature at an interface between the marking material and the surface of the substrate, and $T_m$ is the melting temperature of the toner, the pre-heated toner adheres to the substrate substantially without adhering to the first surface or the second surface; and feeding the pre-heated substrate and marking material to a second nip of a fixing device disposed downstream from the pre-heating device, the second nip being formed by a third surface of a third fixing member and a fourth surface of a fourth fixing member; and applying pressure to the pre-heated substrate and marking material at the second nip to fix the toner to the substrate.

Another exemplary embodiment of the methods comprises applying marking material comprising toner to a substrate with a marking device; feeding the substrate to a first nip of a pre-heating device, the first nip being formed by a first surface of a first fixing member and a second surface of a second fixing member; heating at least one of the first surface and the second surface; contacting and pre-heating the substrate and marking material at the first nip with the first surface and second surface; and feeding the pre-heated substrate and marking material to a second nip of a fixing device disposed downstream from the pre-heating device, the second nip being formed by a third surface of a third fixing member and a fourth surface of a fourth fixing member; heating at least one of the third surface and fourth surface to a temperature of less than about 120° C., wherein the at least one of the third surface and fourth surface that is heated is heated to a temperature of less than about 120° C.; and applying thermal energy and pressure to the pre-heated substrate and marking material at the second nip to fix the toner to the substrate.

In some printing processes, images are formed on substrates using a marking material comprising dry toner. These printing processes may utilize a contact fixing device having opposed fixing members, which form a fixing nip between them. For example, one fixing member can include a fixing roll or a fixing belt and the other fixing member can include a pressure roll. In these fixing devices, an image formed on a substrate is fixed or fused by applying sufficient thermal energy and pressure to the substrate and toner image by contact with the fixing members at the fixing nip.

The fixing of toner onto a substrate can be achieved using high-temperature, low pressure conditions in contact fixing devices. These devices may utilize a roll or belt surface composed of elastomeric materials. In these devices, the elastomeric materials are typically subjected to high surface temperatures of 150° C. to 200° C. and relatively-low fixing nip pressures of 60 psi to 100 psi. These fixing devices are operated at high temperatures to fix the toner material onto the substrate at the fixing nip in milliseconds of dwell time. At these high-temperature conditions, high-temperature-compatible elastomeric materials are required. A liquid release agent may be applied to the elastomeric surfaces in the fixing devices.

FIG. 1 depicts the complex mechanical and chemical interactions that may occur between the substrate, toner, release agent and fixing roll in a contact fixing device during the fixing of toner onto a substrate at a fixing nip. These interactions affect machine performance and service life. The use of high fixing temperatures and reactive chemicals creates a harsh mechanical and chemical operating environment for exposed elastomeric materials of the fixing members. Despite the use of high-temperature-compatible elastomeric materials, these harsh conditions present in contact fixing devices commonly lead to the premature failure of the fixing members.

Another approach to fixing toner onto a substrate that has been used in printing includes non-contact fusing processes that heat the toner material by use of a radiant energy source with low pressure. These fusing processes rely upon radiant energy absorption and viscoelastic flow by the toner material resulting from irradiating the toner with radiant energy. It has been determined that this approach may produce limited image quality, introduces higher material costs due to additional property requirements placed upon the toner material, and also results in limited substrate compatibility.

Another approach to toner fixing that has been applied in printing includes contact fixing processes that use high pressure at ambient temperature to fix the toner to a substrate. Although this approach avoids high-temperatures conditions at the fixing nip, it also places additional requirements on the toner material to enable adequate fixing of the toner onto substrates and typically produces images with limited image, particularly in color printing processes.

As used herein, the term "printing apparatus" can encompass various types of apparatuses that are used to form images on substrates with marking materials. These apparatuses can include printers, copy machines, facsimile machines, multifunction machines, and the like.

In view of the above observations regarding the mechanical and chemical interactions that may occur in a contact fixing device that utilizes high fixing temperatures, printing apparatuses and methods of fixing marking material comprising toner to a substrate are provided. The printing apparatuses and methods utilize a novel regime of applied pressures and temperatures for fixing toner to a substrate. The apparatuses and methods can produce a high image quality output while enabling use of robust, long-life subsystem components. The printing apparatuses and methods use a multi-step, toner fixing process. The fixing process includes pre-heating the toner material on a substrate to a relatively-low temperature using conductive heat transfer at a first nip. The pre-heated toner is then subjected to pressure, or to pressure and heating, at a second nip to flow the pre-heated toner and provide adequate coalescence and adhesion of the toner to the substrate. The printing apparatuses and methods can use a low temperature, moderate pressure second nip or "fixing nip" to achieve fixing of the pre-heated toner.

By performing the toner fixing process as a multi-step process at lower temperatures, lower demands are placed on the fixing device components, enabling application of robust, long-life components. In addition, the use of lower temperatures and moderate pressures can relax demands on the toner material composition and properties. Embodiments of the printing apparatuses and methods can provide high image quality, a high level of printed image permanence, and reduced printing costs.

Figure 2:
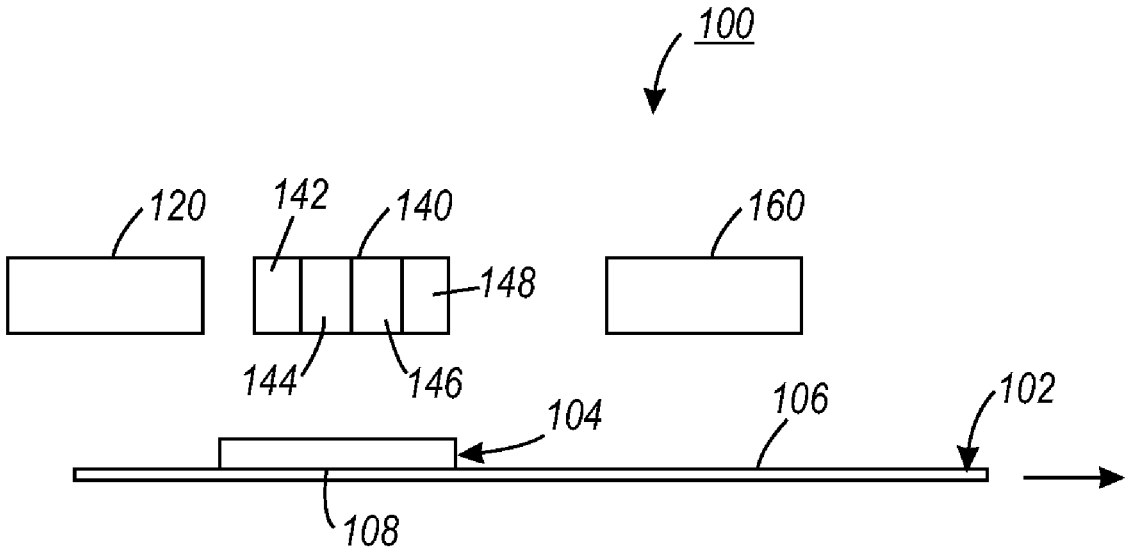
FIG. 2 depicts an exemplary embodiment of a printing apparatus.

FIG. 2 depicts an exemplary embodiment of a printing apparatus 100 for forming images on a substrate 102. The substrate 102 is in the form of a sheet. A continuous web substrate may alternatively be used in the printing apparatus 100. The substrate 102 can comprise coated or uncoated paper, or packaging material, for example. The printing apparatus 100 includes a substrate feeding device 120, a marking device 140, and a fixing system 160 along the process direction. A substrate 102 is fed by the substrate feeding device 120 to the marking device 140 to apply marking material 104 to a front surface 106 of the substrate 102. The marking material 104 comprises toner. The substrate 102 is advanced to the fixing system 160 to fix the toner to the front surface 106.

The marking device 140 can have any suitable configuration for applying marking material comprising toner to the substrate 102. In embodiments, the toner material comprises dry toner particles. The marking material may also comprise one or more additives. The marking device 140 can be constructed to apply marking material directly to the substrate 102 to form toner images. In other embodiments, the marking device 140 can be constructed to apply marking material to an intermediate member, such as a roll or belt, and then to transfer the marking material from the intermediate member to the substrate 102.

The marking device 140 includes marking stations 142, 144, 146 and 148 arranged in series along the process direction. The marking stations 142, 144, 146 and 148 can each apply a different colored toner, such as black, cyan, magenta and yellow toner, respectively, to the front surface 106 of the substrate 102 to form a color image. The marking device 140 can also be used to produce monochromatic images. While the marking device 140 is shown as applying marking material 104 only to the front surface 106 of the substrate 102, other embodiments of the printing apparatus 100 can be configured to produce duplex prints.

Figure 3:
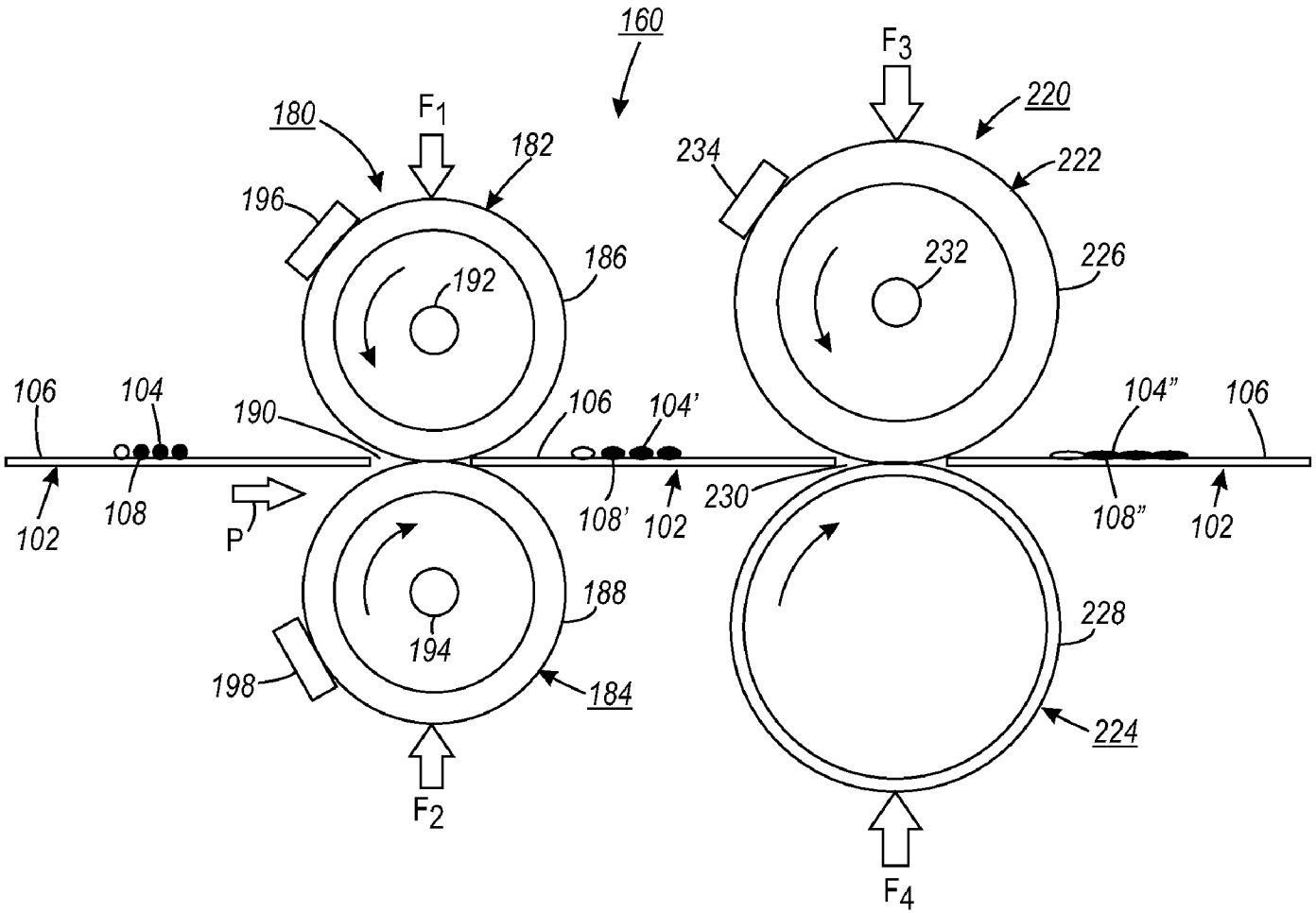
FIG. 3 depicts an exemplary embodiment of a fixing system including a pre-heating device and a fixing device.

The fixing system 160 is provided in the printing apparatus 100 to fix the marking material to the front surface 106 of the substrate 102. FIG. 3 depicts an exemplary embodiment of the fixing system 160. As shown, the fixing system 160 includes a pre-heating device 180 and a fixing device 220 positioned downstream from the pre-heating device 180 along process direction P.

The pre-heating device 180 includes fixing members having opposed surfaces that contact and supply thermal energy to pre-heat the marking material 104 and substrate 102. In the illustrated embodiment, the fixing members include a first roll 182 and a second roll 184. The first roll 182 includes a first outer surface 186 and the second roll 184 includes a second outer surface 188. The first outer surface 186 and second outer surface 188 contact each other to form a first nip 190 at which the substrate 102 is received.

The first outer surface 186 and second outer surface 188 of the first roll 182 and second roll 184, respectively, can comprise a material that does not chemically or electrostatically attract the marking material 104 to minimize offsetting of the marking material 104 to either of these surfaces. For example, the first roll 182 and second roll 184 can comprise a rigid and thermally conductive core to provide strength. The core can be comprised of a metal, such as aluminum, an aluminum-based alloy, copper, a copper-based alloy, steel, or the like. The first roll 182 and second roll 184 can comprise a thin (e.g., about 15 μm to about 300 μm thick) outer layer of a material having toner release properties and/or high durability, such as Teflon® (polytetrafluoroethylene), Teflon® PFA (a perfluoroalkoxy copolymer), or the like.

In other embodiments, the first roll 182 and second roll 184 can include a metallic or ceramic substrate having a surface region impregnated with a material to provide release characteristics. For example, the first roll 182 and second roll 184 can comprise an aluminum substrate that has been subjected to an anodizing treatment to convert the surface region of the substrate, including the first outer surface 186 and second outer surface 188, to porous anodized aluminum (aluminum oxide, $Al_2O_3$). The pores of the anodized surface region can be impregnated with a suitable liquid substance to seal the open pores. The open pores can be impregnated with a substance having desirable release properties, such as Teflon®, Teflon® PFA, or the like, to seal the pores. In this sealing process, the lubricant is encapsulated. The resulting first outer surface 186 and second outer surface 188 provide desirable hardness and release properties.

The pre-heating device 180 includes a thermal energy source for heating the first outer surface 186 and/or the second outer surface 188. When the marking material 104 is applied to only the front surface 106 of the substrate 102, as shown, the first outer surface 186 is heated and the second outer surface 188 may optionally also be heated. As shown, the first roll 182 includes an internal heating element 192 for heating the first outer surface 186 to a desired temperature, and the second roll 184 includes an internal heating element 194 for heating the second outer surface 188 to a desired temperature. A temperature sensor 196 is positioned adjacent to the first outer surface 186 and a temperature sensor 198 is positioned adjacent to the second outer surface 188. In other embodiments, the first roll 182 and/or second roll 184 may alternatively or additionally be externally heated.

Forces $F_1$ and $F_2$ are applied to the first roll 182 and second roll 184, respectively, to produce the desired amount of pressure at the first nip 190. Typically, the pressure at the first nip 190 can be from about 300 psi to about 2000 psi. Increasing the pressure at the first nip 190 increases the length of the first nip 190. The dwell may be defined as the nip length/process speed. Accordingly, increasing the nip pressure increases dwell at the first nip 190. At the first nip 190, the first outer surface 186 and second outer surface 188 heat the substrate 102 and the marking material 104 disposed on the front surface 106 by conduction, while also applying pressure to the substrate 102 and marking material 104, to heat the interface 108 between the substrate 102 and toner 104 to a desired pre-heat temperature. Typically, the dwell can range from about 10 ms to about 30 ms at the first nip 190.

At the first nip 190, the use of conductive pre-heating controls and limits the maximum temperature that the marking material 104 is exposed to and also provides efficient heat transfer to the marking material 104. The pre-heating device 180 is operable to heat the substrate 102 and marking material 104 to achieve a temperature, $T_{int}$, at the interface 108 between the substrate 102 and toner 104 that is desirable for the toner contained in the marking material 104. The substrate 102 and marking material 104 may or may not be actively heated in the printing apparatus 100 prior to reaching the first nip 190. When the substrate 102 and marking material 104 are not actively heated, the substrate 102 and marking material enter the first nip 190 at about the ambient temperature of the cavity of the printing apparatus 100, $T_{amb}$. At the first nip 190, $T_{int}$ is increased from about ambient temperature to less than the melt temperature, $T_m$ of the toner, i.e., $T_{amb}<T_{int}<T_m$. For example, $T_{int}$ may reach about 30° C. to about 100° C. at the first nip 190. The modulus of the toner is reduced and the toner may be partially fused by this heating. The temperatures of the first outer surface 186 and second outer surface 188 can be set to the same temperature set-point that is effective to achieve the desired value of $T_{int}$. For example, the temperature set-point may be from about 50° C. to about 100° C. By pre-heating the substrate 102 and toner to low temperature, significant softening of the toner can be avoided, and offset tendency of the marking material to the first outer surface 186 and/or second outer surface 188 can be reduced. Also, by reaching a maximum value of $T_{int}$ of less than 100° C. at the first nip 190, problems caused by the vaporization of water contained in print media, which include damage to the media (blistering) and/or damage to the images (e.g., blow-off or icicles), can be avoided in the printing apparatus 100.

In FIG. 3, the marking material 104 is depicted as comprising generally spherical toner particles prior to reaching the first nip 190. The pre-heated toner particles of the marking material 104' on the substrate 102 have a flattened shape resulting from passing through the first nip 190. The toner particles of the marking material 104' are depicted as discrete particles separated from each other. Pre-heating the substrate 102 and toner with the pre-heating device 180 using contact pre-heating allows the fixing device 220 to operate at lower fixing temperatures as compared to a fixing device that does not utilize pre-heating and is required to heat toner from ambient temperature to the fixing temperature at the fixing nip within a short dwell time. Suitably-high process speeds also can be achieved in the printing apparatus 100 when these reduced fixing temperatures are used in the fixing device 220.

The illustrated embodiment of the fixing device 220 is configured to apply additional energy to the pre-heated substrate 102 and toner to cause the toner particles to coalesce (cohere) and also provide adequate adhesion of the image to the substrate 102 for uses the prints. The total amount of energy supplied to the substrate 102 and marking material 104 at the first nip 190, which includes thermal energy conducted from the first roll 182 and second roll 184, and energy provided the application of pressure, is sufficient to allow the fixing device 220 to achieve adequate toner adhesion and cohesion while being operated at relatively-low temperature and moderate pressure conditions, as well as to operate at a lower dwell.

The illustrated fixing device 220 includes a third roll 222 and a fourth roll 224. The third roll 222 includes a third outer surface 226 and the fourth roll 224 includes a fourth outer surface 228 forming a second nip 230. As shown, the third roll 222 and fourth roll 224 can have a larger outer diameter than the first roll 182 and second roll 184. At the second nip 230, the substrate 102 and marking material 104' are contacted by the third roll 222 and fourth roll 224 and subjected to additional heating and applied pressure. FIG. 3 shows the toner particles of the marking material 104" having a more flatted shape and being coalesced as a result of passing through the second nip 230.

The third roll 222 can be internally and/or externally heated by a thermal energy source. As shown, the thermal energy source can comprise an internal heating element 232 powered to heat the outer surface 226 of the third roll 222 to the fixing temperature. A temperature sensor 234 is positioned adjacent to the third outer surface 226.

In embodiments, the third roll 222 can be comprised of the same material(s) as the first roll 182 and the second roll 184 of the pre-heating device, or can be comprised of different materials.

The fourth roll 224 can comprise a solid (non-deformable) core and a deformable polymeric material overlying the core and forming the outer surface 228. For example, the polymeric material can be polyurethane, nitrile butadiene rubber, or the like. The polymeric material can be applied as a single layer, or as two or more layers. Different layers of multi-layer constructions can have a different composition and properties from each other, e.g., a different elastic modulus.

In other embodiments of the fixing device 220, the fourth roll 224 optionally can also be internally and/or externally heated to heat the fourth outer surface 228.

Forces $F_3$ and $F_4$ are applied to the third roll 222 and second roll 224, respectively, to produce the desired amount of pressure at the second nip 230. Typically, the pressure at the second nip 230 can be from about 50 psi to about 500 psi.

At the second nip 230, the use of conductive pre-heating also limits the maximum temperature that the pre-heated marking material 104' is exposed to and also provides efficient heat transfer to the marking material 104'. The fixing device 220 is operable to heat the substrate 102 and marking material 104' to achieve a temperature, $T_{int}$, at the interface 108' between the substrate 102 and marking material 104 that is sufficient to achieve adequate coherence and adhesion of the toner. Some cooling of the substrate 102 and marking material 104' will occur during movement between the first nip 190 and second nip 230. Depending on the process speed of the printing apparatus 100 and the distance between the first nip 190 and second nip 230 along the process direction, the substrate 102 can typically reach the inlet of the second nip 230 within about 100 ms to about 1000 ms after exiting the first nip 190. Reducing this travel time reduces cooling of the substrate 102 and marking material 104'.

When the substrate 102 and marking material 104' enter the second nip 230, $T_{int}$ at the interface 108' is above $T_{amb}$. At the second nip 230, $T_{int}$ is increased to above $T_m$ of the toner. At the second nip 230, $T_{int}$ can reach about 50° C. to about 120° C., such as about 70° C. to about 100° C., or about 70° C. to about 90° C., for fixing the toner on the substrate 102. The temperature set point for the outer surface 226 of the third roll 222 can be about be about 50° C. to about 120° C., such as about 70° C. to about 100° C., or about 70° C. to about 90° C. By operating at a maximum value of $T_{int}$ of less than 100° C. at the second nip 230, the vaporization of water contained in print media can be avoided.

In the printing apparatus 100, the pre-heating temperature achieved by the pre-heating device 180 and the fixing temperature achieved by the fixing device 220 can be adjusted for different substrate materials and types. For example, for a heavy-weight paper substrate 102 (coated or uncoated), the pre-heating temperature and/or fixing temperature can be increased as compared to the pre-heating and fixing temperatures that may be used for a light-weight paper substrate 102.

In other embodiments of the fixing system, the fixing device may have a construction including a belt configuration for one or more of the fixing members, such as a fixing belt provided in combination with the fourth roll 224.

In embodiments, the pre-heating device 180 and the fixing device 220 can each include a release agent applicator system (not shown) for applying a release agent to the first outer surface 186 of the first roll 182 and the second outer surface 188 of the second roll, and to the third outer surface 226 of the third roll 222, respectively. The release agent enhances the production of images with sufficient image durability, while avoiding image offset, at the lower temperatures used in the pre-heating device 180 and fixing device 220. The release agent can also assist in stripping of the substrate from the fixing roll 222 following fixing. In the fixing device 220, the use of lower fixing temperatures at the second nip 230 allows the use of release agents having a lower viscosity (and vapor pressure) than release agents that are suitable for use at higher fixing temperatures.

In the printing apparatus 100, using contact pre-heating of the substrate 102 combined with a relatively lower temperature at the second nip 230 can facilitate the use of low-melting and ultra-low-melting toner materials, for example. Exemplary ultra-low-melting toners comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner.

Figure 4:
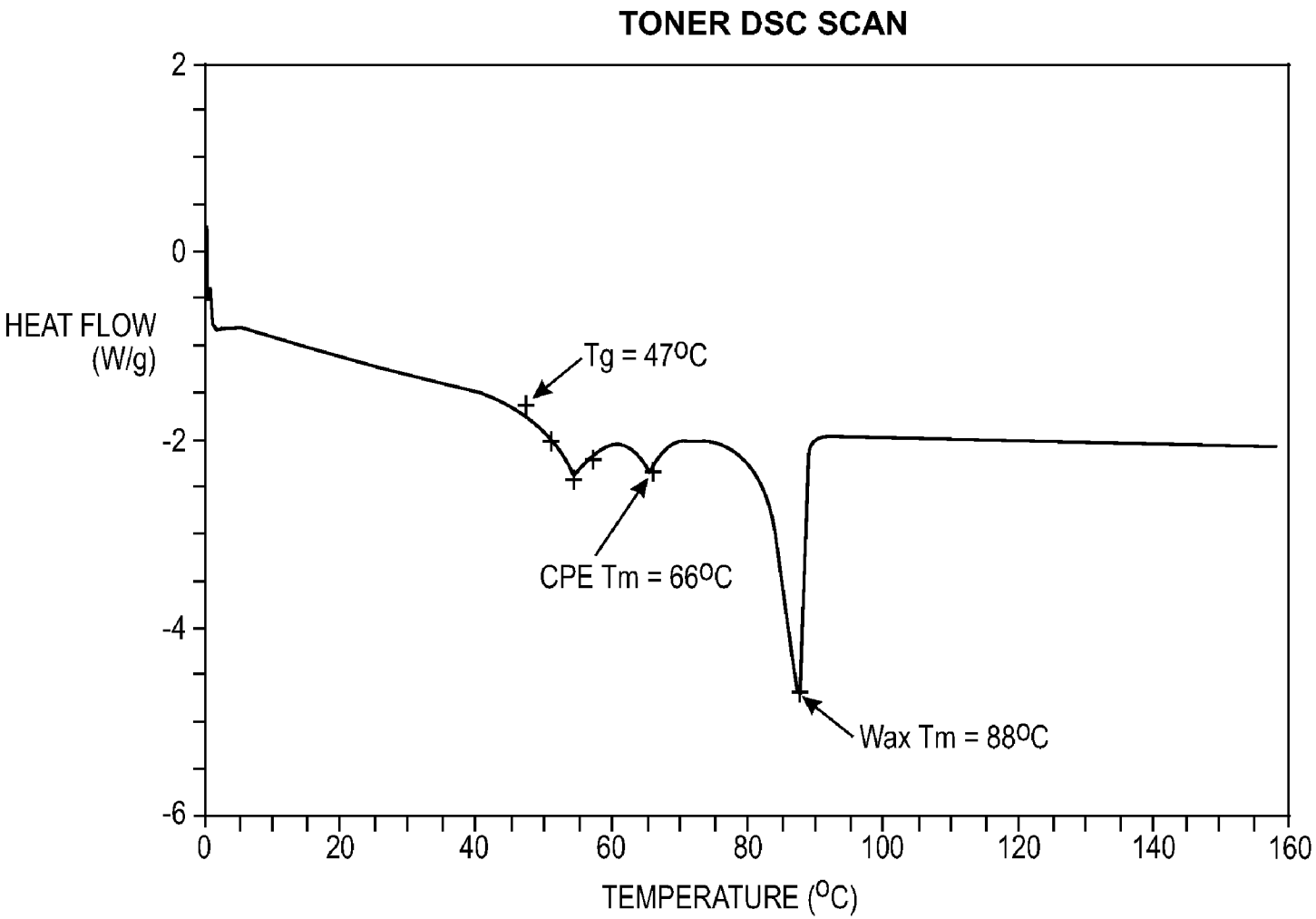
FIG. 4 depicts a differential scanning calorimetry (DSC) scan of heat flow versus temperature for an exemplary toner material.

FIG. 4 shows a differential scanning calorimetry (DSC) scan of heat flow versus temperature for an exemplary toner material that can be used in embodiments of the printing apparatus 100. The toner contains a crystalline polyester resin, an amorphous polyester resin, and a wax. As shown, the amorphous base resin has a glass transition onset temperature, $T_g$, of 47° C., the crystalline polyester resin has a melting temperature, CPE $T_m$, of 66° C., and the wax has a melting temperature, Wax $T_m$, of 88° C.

Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

As the operating set-points used in embodiments of the printing apparatuses accommodate low substrate temperatures, substrate distortion issues that can occur at elevated process temperatures can be avoided. This feature can extend the substrate application space achieved with xerographic printing systems. For example, polymeric film materials used in packaging may be used as the substrate in the printing apparatuses. The use of low operating temperatures also reduces or avoids water evaporation and reabsorption by paper and, consequently, can minimize or eliminate this potential source for paper distortion.

Although the fixing device 220 is described herein as including a thermal energy source, other embodiments of the fixing device that can be used in the printing apparatus may not include a thermal energy source to heat either of the third roll 222 or the fourth roll 224.

EXAMPLES

Figure 5:
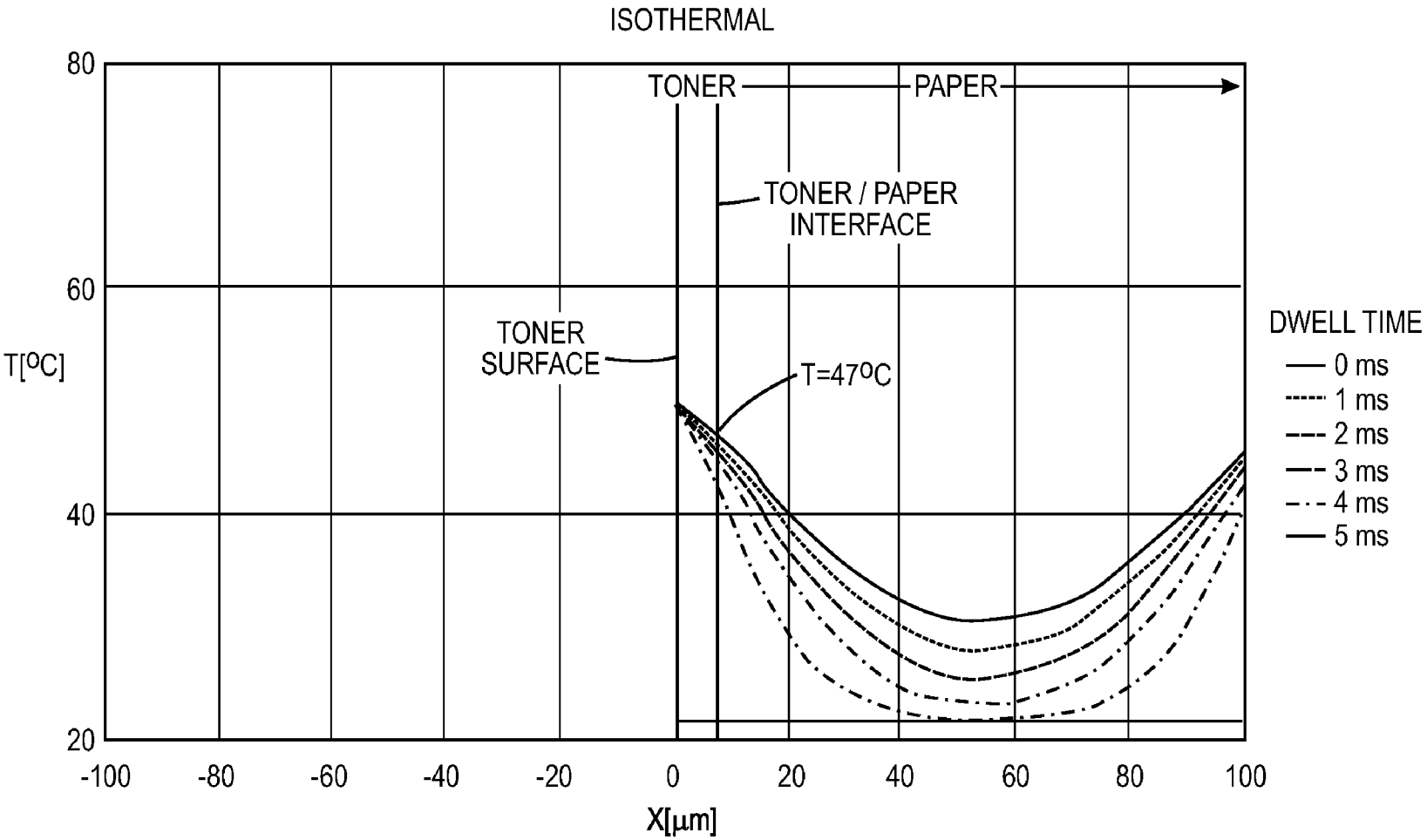
FIG. 5 shows the results of a numerical simulation for heating a heavy-weight, uncoated paper substrate having a surface with toner on the surface using a contact pre-heater including opposed rolls forming a pre-heating nip.

FIG. 5 shows the results of a numerical simulation for heating a heavy-weight, uncoated paper substrate having a surface with toner on the surface using a contact pre-heater device including opposed rolls forming a pre-heating nip. The rolls each have a temperature set point of 50° C. In FIG. 5, the temperature, T, is plotted versus position, x, for nip dwell times of 0 ms, 1 ms, 2 ms, 3 ms, 4 ms and 5 ms. x=0 μm corresponds to the position of the top surface of the toner layer. The position of the interface between the toner and the substrate surface is indicated. The paper and toner are at ambient temperature of 22° C. before being heated. The results show that by heating the paper and toner for 5 ms at the temperature set point of 50° C., the toner/paper interface temperature is increased to 47° C. upon exit from the nip.

Figure 6:
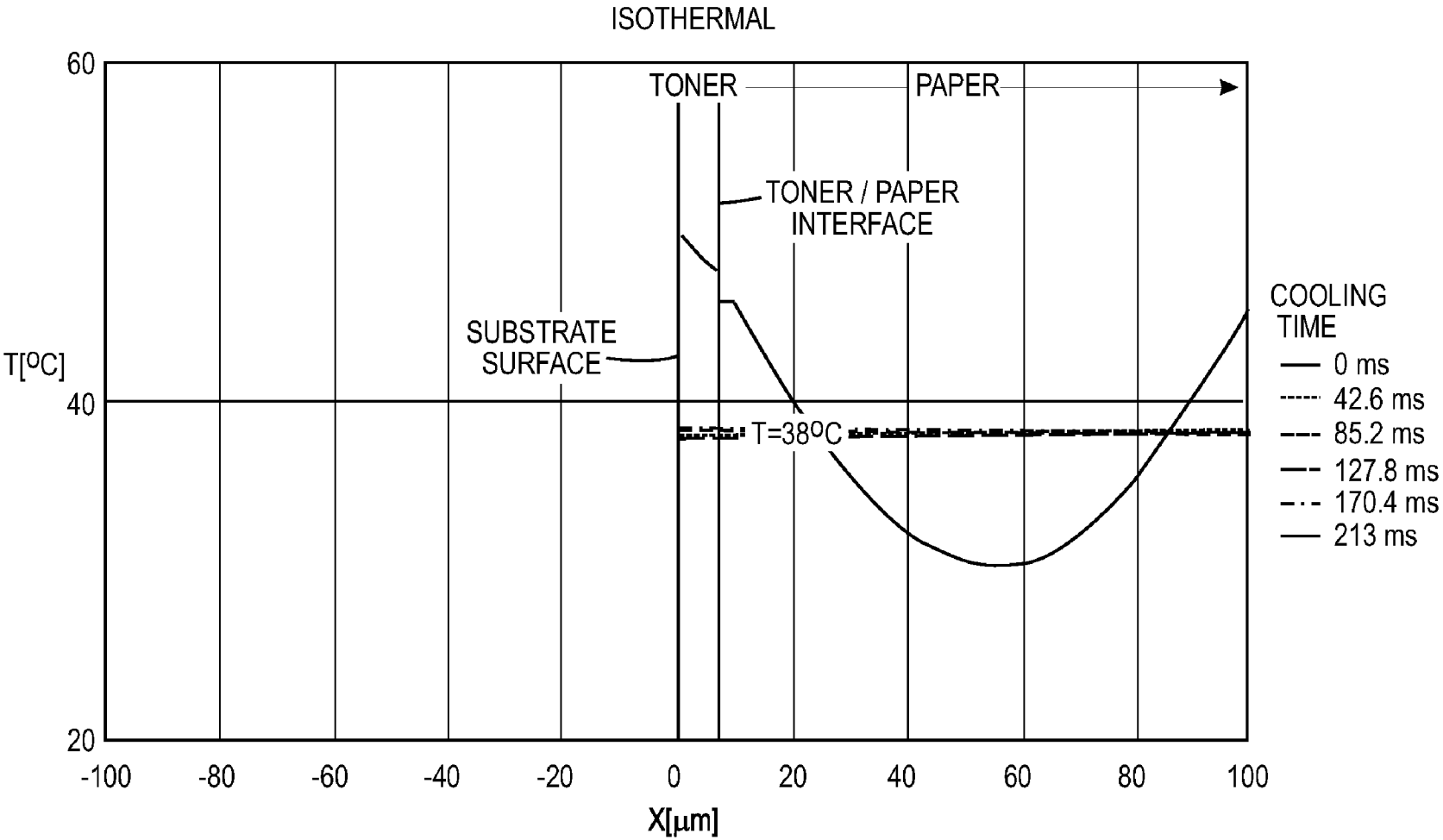
FIG. 6 shows the results of a numerical simulation for the cooling of a paper substrate with toner on the substrate surface from a toner/paper interface temperature of 47° C. at ambient temperature of 22° C.

FIG. 6 shows the results of a numerical simulation for the cooling of the same paper substrate and toner as in FIG. 5 starting from a toner/paper interface temperature of 47° C. (5 ms dwell) at ambient temperature of 22° C. Cooling times of 0 ms, 42.6 ms, 85.2 ms, 127.8 ms, 170.4 ms and 213 ms are used. The results show that after a cooling time of 213 ms, the toner/paper interface temperature is decreased to 38° C.

Figure 7:
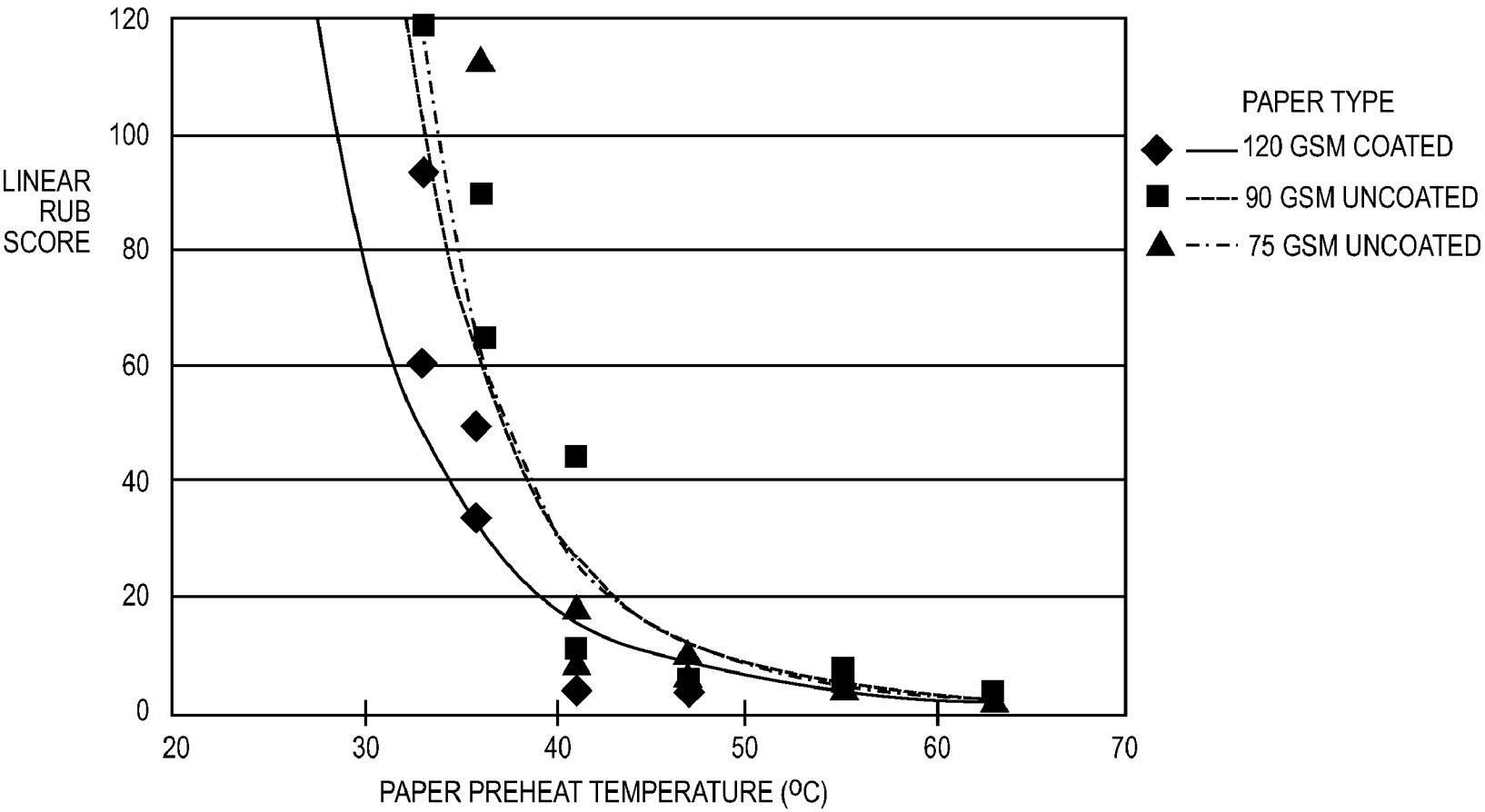
FIG. 7 shows plots of linear rub score for a toner applied to paper versus paper pre-heat temperature for three different types of paper, where the toner is fixed to the paper using pressure without active heating of the paper and toner.

FIG. 7 shows plots of linear rub score for toner applied to paper versus paper pre-heat temperature for 120 gsm coated paper, 90 gsm uncoated paper and 75 gsm uncoated paper, where the paper and toner is pre-heated using a contact pre-heating device and the toner is fixed to the paper using a fixing pressure of 5,000 psi in a fixing device including rolls without active heating of the rolls. For the results, a linear rub score of less than 40 is considered to indicate good fix of the toner to the paper. The empirical data show that pre-heating the paper and toner to reach a toner/paper interface temperature of at least about 38° C. prior to entering the fixing nip, without active heating of the paper and toner at the fixing nip, results in acceptable fix performance.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fixing system for fixing marking material to a substrate, comprising:

a pre-heating device comprising:

a first fixing member including a first surface;

a second fixing member including a second surface forming a first nip with the first surface; and a first thermal energy source for heating at least one of the first surface and the second surface;

wherein the first surface and the second surface contact and pre-heat a substrate and marking material comprising toner disposed on a surface of the substrate when the substrate is received at the first nip to produce the temperature condition: Tamb <Tint <Tm, where Tamb is the ambient temperature, Tint is the temperature at an interface between the marking material and the surface of the substrate, and Tm is the melting temperature of the toner, the pre-heated toner adheres to the substrate substantially without adhering to the first surface or the second surface; and a fixing device disposed downstream from the pre-heating device comprising:

a third fixing member including a third surface; and a fourth fixing member including a fourth surface forming a second nip with the third surface at which the pre-heated substrate is received;

wherein:

the third fixing member and fourth fixing member apply pressure to the pre-heated substrate and marking material at the second nip to fix the toner to the substrate, the fixing device comprises a second thermal energy source for heating at least one of the third surface and fourth surface, the first fixing member comprises a first roll including the first surface, the second fixing member comprises a second roll including the second surface, the third fixing member comprises a third roll including the third surface, the fourth fixing member comprises a fourth roll including the fourth surface, the first thermal energy source heats at least one of the first surface and the second surface to a temperature from about 50° C. to about 100° C., the second thermal energy source heats the third surface to a temperature of about 70° C. to about 120° C., the first roll and second roll are operable to apply a pressure of about 300 psi to about 2000 psi to the substrate and marking material at the first nip, and the third roll and fourth roll are operable to apply a pressure of about 50 psi to about 500 psi to the pre-heated substrate and marking material at the second nip.

2. The fixing system of claim 1, wherein:

the first roll comprises a rigid core and a first outer layer including the first surface over the core, the first outer layer comprising a material having toner release properties; and the second roll comprises a rigid core and a second outer layer including the second surface over the core, the second outer layer comprising a material having toner release properties.

3. The fixing system of claim 1, wherein the first surface of the first roll and the second surface of the second roll are impregnated with a material having toner release properties.

4. The fixing system of claim 1, wherein the third surface comprises anodized aluminum impregnated with a material having tone release properties.

5. The fixing system of claim 1, wherein the fixing device does not include a thermal energy source that actively heats the third roll or the fourth roll.

6. A printing apparatus, comprising:

the fixing system according to claim 1; and a marking device for applying the marking material to the substrate before being received at the first nip, wherein the marking device comprises at least one marking station, each marking station contains a supply of the marking material for applying to the substrate.

7. A fixing system, comprising:

a pre-heating device comprising:

a first fixing member including a first surface;

a second fixing member including a second surface forming a first nip with the first surface; and a first thermal energy source for heating at least one of the first surface and the second surface;

wherein the first surface and the second surface contact and pre-heat a substrate and marking material comprising toner disposed on the substrate when the substrate is received at the first nip; and a fixing device disposed downstream from the pre-heating device comprising:

a third fixing member including a third surface;

a fourth fixing member including a fourth surface forming a second nip with the third surface at which the pre-heated substrate is received; and a second thermal energy source for heating at least one of the third surface and fourth surface, wherein:

the third fixing member and forth fixing member apply pressure to the pre-heated substrate and marking material at the second nip to fix the toner to the substrate, the first fixing member comprises a first roll including the first surface, the second fixing member comprises a second roll including the second surface, the third fixing member comprises a third roll including the third surface, the fourth fixing member comprises a fourth roll including the fourth surface, the first thermal energy source heats at least one of the first surface and the second surface to a temperature from about 50° C. to about 100° C., the second thermal energy source heats the third surface to a temperature of about 70° C. to about 120° C., the first roll and second roll are operable to apply a pressure of about 300 psi to about 2000 psi to the substrate and marking material at the first nip, and the third roll and fourth roll are operable to apply a pressure of about 50 psi to about 500 psi to the pre-heated substrate and marking material at the second nip.

8. The fixing system of claim 7, wherein:

the first roll comprises a rigid core and a first outer layer including the first surface over the core, the first outer layer comprising a material having toner release properties; and the second roll comprises a rigid core and a second outer layer including the second surface over the core, the second outer layer comprising a material having toner release properties.

9. The fixing system of claim 7, wherein the first surface of the first roll and the second surface of the second roll are impregnated with a material having toner release properties.

10. The fixing system of claim 7, wherein the third outer surface comprises anodized aluminum impregnated with a material having toner release properties.

11. A printing apparatus, comprising:

the fixing system of claim 7; and a marking device for applying the marking material to the substrate before being received at the first nip, wherein the marking device comprises at least one marking station, each marking station contains a supply of the marking material for applying to the substrate.

12. A method of fixing toner to a substrate, comprising:

applying marking material comprising toner to a substrate with a marking device;

feeding the substrate to a first nip of a pre-heating device, the first nip being formed by a first surface of a first fixing member and a second surface of a second fixing member;

heating at least one of the first surface and the second surface;

contacting and pre-heating the substrate and marking material at the first nip to produce the temperature condition: $Tamb<Tint<Tm$, where Tamb is the ambient temperature, Tint is the temperature at an interface between the marking material and the surface of the substrate, and Tm is the melting temperature of the toner, the pre-heated toner adheres to the substrate substantially without adhering to the first surface or the second surface; and feeding the pre-heated substrate and marking material to a second nip of a fixing device disposed downstream from the pre-heating device, the second nip being formed by a third surface of a third fixing member and a fourth surface of a fourth fixing member; and applying pressure to the pre-heated substrate and marking material at the second nip to fix the toner to the substrate, wherein the fixing device comprises a second thermal energy source for heating at least one of the third surface and fourth surface, the first fixing member comprises a first roll including the first surface, the second fixing member comprises a second roll including the second surface, the third fixing member comprises a third roll including the third surface, the fourth fixing member comprises a fourth roll including the fourth surface, the first thermal energy source heats at least one of the first surface and the second surface to a temperature from about 50° C. to about 100° C., the second thermal energy source heats the third surface to a temperature of about 70° C. to about 120° C., the first roll and second roll are operable to apply a pressure of about 300 psi to about 2000 psi to the substrate and marking material at the first nip, and the third roll and fourth roll are operable to apply a pressure of about 50 psi to about 500 psi to the pre-heated substrate and marking material at the second nip.

13. The method of claim 12, wherein the substrate is advanced from the first nip of the pre-heating device to the second nip of the fixing device within about 100 ms to about 1000 ms.

14. The method of claim 12, wherein the substrate and marking material are not actively heated before being fed to the first nip of the pre-heating device and are at a temperature of about Tamb when fed to the first nip.

15. The method of claim 12, wherein the toner comprises a crystalline polymer material and an amorphous polymer material, the toner having a melting temperature which is lowered by heating the toner to a temperature above a threshold temperature.

16. The method of claim 12, wherein the substrate comprises a polymer film.

17. A method of fixing toner to a substrate, comprising:

applying marking material comprising toner to a substrate with a marking device;

feeding the substrate to a first nip of a pre-heating device, the first nip being formed by a first surface of a first fixing member and a second surface of a second fixing member;

heating at least one of the first surface and the second surface;

contacting and pre-heating the substrate and marking material at the first nip with the first surface and second surface; and feeding the pre-heated substrate and marking material to a second nip of a fixing device disposed downstream from the pre-heating device, the second nip being formed by a third surface of a third fixing member and a fourth surface of a fourth fixing member;

heating at least one of the third surface and fourth surface; and applying thermal energy and pressure to the pre-heated substrate and marking material at the second nip to fix the toner to the substrate, wherein the fixing device comprises a second thermal energy source for heating at least one of the third surface and fourth surface, the first fixing member comprises a first roll including the first surface, the second fixing member comprises a second roll including the second surface, the third fixing member comprises a third roll including the third surface, the fourth fixing member comprises a fourth roll including the fourth surface the first thermal energy source heats at least one of the first surface and the second surface to a temperature from about 50° C. to about 100° C., the second thermal energy source heats the third surface to a temperature of about 70° C. to about 120° C., the first roll and second roll are operable to apply a pressure of about 300 psi to about 2000 psi to the substrate and marking material at the first nip, and the third roll and fourth roll are operable to apply a pressure of about 50 psi to about 500 psi to the pre-heated substrate and marking material at the second nip.

18. The method of claim 17, wherein the substrate is advanced from the first nip of the pre-heating device to the second nip of the fixing device within about 100 ms to about 1000 ms.

19. The method of claim 17, wherein the substrate and marking material are not actively heated before being fed to the first nip of the pre-heating device and are at a temperature of about Tamb when fed to the first nip.

20. The method of claim 17, wherein the toner comprises a crystalline polymer material and an amorphous polymer material, the toner having a melting temperature which is lowered by heating the toner to a temperature above a threshold temperature.

21. The method of claim 17, wherein the substrate comprises a polymer film.

* * * * *